US007710333B2

(12) United States Patent
Byrne et al.

(10) Patent No.: US 7,710,333 B2
(45) Date of Patent: May 4, 2010

(54) FASTENING AND CONNECTION APPARATUS FOR A PANEL-MOUNTED VEHICLE ANTENNA MODULE

(75) Inventors: Steven V. Byrne, Goodrich, MI (US); Loren M. Thompson, Lapeer, MI (US)

(73) Assignee: Delphi Technologies, Inc., Troy, MI (US)

( * ) Notice: Subject to any disclaimer, the term of this patent is extended or adjusted under 35 U.S.C. 154(b) by 1020 days.

(21) Appl. No.: 11/437,363

(22) Filed: May 19, 2006

(65) Prior Publication Data

US 2007/0279302 A1 Dec. 6, 2007

(51) Int. Cl.
*H01Q 1/32* (2006.01)

(52) U.S. Cl. ..... 343/713; 343/906

(58) Field of Classification Search ..... 343/711–715, 343/906

See application file for complete search history.

(56) References Cited

U.S. PATENT DOCUMENTS 6,930,643 B2 8/2005 Byrne et al.
7,215,291 B2 * 5/2007 Nakano et al. ..... 343/715

FOREIGN PATENT DOCUMENTS

EP 0 632 520 1/1995
EP 1 648 049 4/2006
EP 1 653 555 5/2006
FR 2 691 841 12/1993
FR 2 773 913 7/1999

OTHER PUBLICATIONS

EP Search Report dated Aug. 21, 2007.

* cited by examiner

*Primary Examiner*—Michael C Wimer
(74) *Attorney, Agent, or Firm*—Jimmy L. Funke

(57) ABSTRACT

A panel-mounted vehicle antenna module includes exterior and interior components that are joined in a single operation to simultaneously achieve both mechanical fastening of the module and through-the-panel electrical connections of the antenna. The exterior and interior components are equipped with electrical connector terminals that are coupled when the exterior and interior components are joined, and alignment features that ensure accurate alignment of the connector terminals. The exterior component is temporarily retained against the panel, the interior component is temporarily attached to the exterior component, and a bolt is driven from the interior component into the exterior component to complete the mechanical attachment and electrical connections. Electrical cables hard-wired to the interior component are connected to the vehicle wiring harness to complete the installation.

8 Claims, 3 Drawing Sheets

FASTENING AND CONNECTION APPARATUS FOR A PANEL-MOUNTED VEHICLE ANTENNA MODULE

TECHNICAL FIELD

The present invention relates to an antenna module for a panel such as the roof of a vehicle, and more particularly to a fastening and electrical connection apparatus for the module.

BACKGROUND OF THE INVENTION

Factory installation of a panel-mounted vehicle antenna module is often an awkward and time-consuming process. In a typical installation, electrical jumper wires from the antenna module are fed through an opening in the vehicle roof, whereafter the module is fastened to the roof with screws or a threaded nut, and the jumper wires individually connected to a wiring harness in the cabin of the vehicle. See, for example, the U.S. Pat. No. 6,930,643, issued on Aug. 16, 2005, and incorporated herein by reference. What is desired is an antenna module that can be easily and quickly installed without compromising the reliability of the mechanical and electrical connections.

SUMMARY OF THE INVENTION

The present invention is directed to an improved panel-mounted antenna module for a vehicle including an exterior component and an interior component that are joined in a single operation to simultaneously achieve both mechanical fastening of the module and through-the-panel electrical connections of the antenna. The interior and exterior components are equipped with electrical connectors that are coupled when the interior and exterior components are joined, and alignment features that ensure accurate alignment of the connector terminals. The exterior component includes a gasket that seals against the panel, and a set of metal tangs that temporarily retain the exterior component in position while the interior component is installed from the panel interior. The interior component includes a set of resilient hooks that engage a shoulder of the exterior component to temporarily retain the interior component in place, and a bolt that is tightened to complete the electrical connections and to permanently join the interior and exterior components. Preferably, the interior component also includes a set of electrical jumper cables that are hard-wired to the respective electrical connectors to simplify connection of the module to the vehicle wiring harness.

BRIEF DESCRIPTION OF THE DRAWINGS

FIG. 2A illustrates the exterior component temporarily retained in place on the panel and an initial positioning of the interior component; FIG. 2B illustrates temporary mechanical retention of the interior component; FIG. 2C illustrates partially completed permanent attachment of the interior and exterior components and their electrical connector terminals; and FIG. 2D illustrates the completed permanent attachment of the interior and exterior components.

DESCRIPTION OF THE PREFERRED EMBODIMENT

Figure 1:
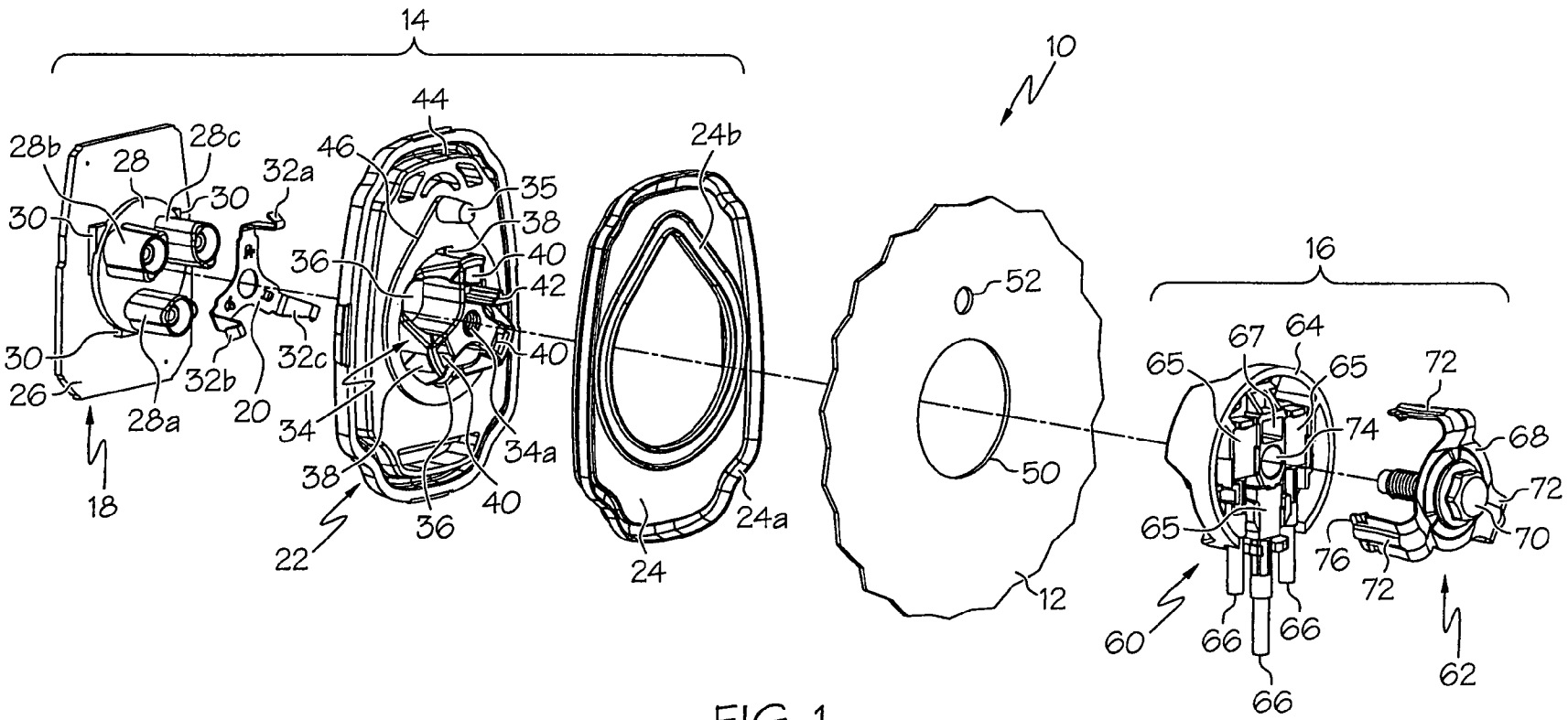
FIG. 1 is an exploded view of a panel-mounted vehicle antenna module according to the present invention.

Referring to FIG. 1, the reference numeral 10 generally designates the panel-mounted antenna module of this invention, disassembled in part to more clearly illustrate its constituent elements, and the reference numeral 12 designates an exterior panel of a vehicle, such as a roof panel. In general, the antenna module 10 includes an exterior component 14 that is installed against an exterior or outside surface of the panel 12, and an interior component 16 that is installed against an interior or inside surface of the panel 12 (that is, from inside the vehicle cabin if the panel 12 is a roof panel).

The exterior component 14 of antenna module 10 includes an electrical assembly 18, a metal retainer clip 20, a housing 22, and a rubber or polymeric gasket 24. The electrical assembly 18 includes a printed circuit board 26 and a three-terminal FAKRA-standard SMB connector 28 electrically coupled at its base 30 to the inboard face of circuit board 26. A conventional exterior-mount antenna assembly (not shown) such as depicted In the aforementioned U.S. Pat. No. 6,930,643 is fastened to housing 22 and electrically coupled to the outboard face of circuit board 26. Various electronic devices (also not shown) mounted on the circuit board 26 condition the received radio frequency signals and couple them to the connector terminals 28*a*, 28*b*, 28*c*. The retainer clip 20 includes a set of three prongs or tangs 32*a*, 32*b*, 32*c* that nest between the connector terminals 28*a*, 28*b*, 28*c* and extend toward the panel 12. The housing 22 has a central Y-shaped boss 34 with a threaded central opening 34*a*, and an alignment post 35. The boss 34 has a first set of peripheral openings 36 through which the connector terminals 28*a*-28*c* pass, and a second set of peripheral openings 38 through which the tangs 32*a*-32*c* of retainer clip 20 protrude. A third set of openings 40 in the inboard face of boss 34 are used for temporary mechanical attachment of the exterior and interior components 14 and 16 as explained below. A standoff post 42 extending out of boss 34 toward panel 12 presets the installed spacing between exterior and interior components 14 and 16. Finally, the housing 22 includes a trough 44 at its periphery for receiving the outer periphery 24*a* of gasket 24; the inner periphery 24*b* of gasket 24 seats against the base of housing 22 adjacent a housing lip 46 surrounding the boss 34 and alignment post 35.

The panel 12 is provided with a major opening 50 for receiving the housing boss 34 and terminals 28*a*-28*c*, and a minor opening 52 for receiving the housing alignment post 35. The orientation of the openings 50 and 52 serve to properly align the antenna module 10 relative to the panel 12. The inner periphery 24*b* of gasket 24 seals around the panel openings 50 and 52, while the outer periphery 24*a* of gasket 24 seals around the housing 22 of exterior component 14. The tangs 32-32*c* of retainer clip 20 protrude radially outward from the boss openings 38, and engage the inner periphery of the panel 12 about the major opening 50 when the exterior component 14 is pushed into place on panel 12 by an installer. This temporarily retains the exterior component 14 in place on the panel 12 while the interior component 16 is installed.

The interior component 16 includes a connector assembly 60 and a clamp assembly 62. The connector assembly 60 has a housing 64 in which are mounted a set of three FAKRA-standard SMB connector terminals 65 designed to mate with the connector terminals 28*a*-28*c* of exterior component 14. A set of cables 66 applied to the connector terminals 65 pass through a sidewall of housing 64, and terminate in connectors (not shown) for attachment to a wiring harness in the vehicle cabin. The housing 64 also includes an opening 67 for receiving the standoff post 42 of exterior component 14, and a set of three integrally fashioned finger hooks (hidden in FIG. 1) that are received in the boss openings 40 of exterior component 14 to effect temporary mechanical attachment of the interior and exterior components 14 and 16 during their installation on panel 12. The clamp assembly 62 includes a three-legged metal clip 68 and a captive bolt 70 that is received in the threaded opening 34*a* of boss 34 for permanent attachment of the exterior and interior components 14 and 16. The legs 72 of clip 68 pass through suitable openings in the connector assembly housing 64, and the bolt 70 passes through a central opening 74. The clip 68 is retained in the housing 64 by tangs 76 formed on the ends of the legs 72.

The sectional views of FIGS. 2A-2D are taken through the bolt 70 and alignment post 35, and illustrate an installation of the exterior and interior components 14 and 16 of antenna module 10 on panel 12 and the functionality of the aforementioned constituent elements. FIGS. 2A-2D depict one of the previously mentioned but un-shown finger hooks 80 of interior component housing 64.

Figure 2A:
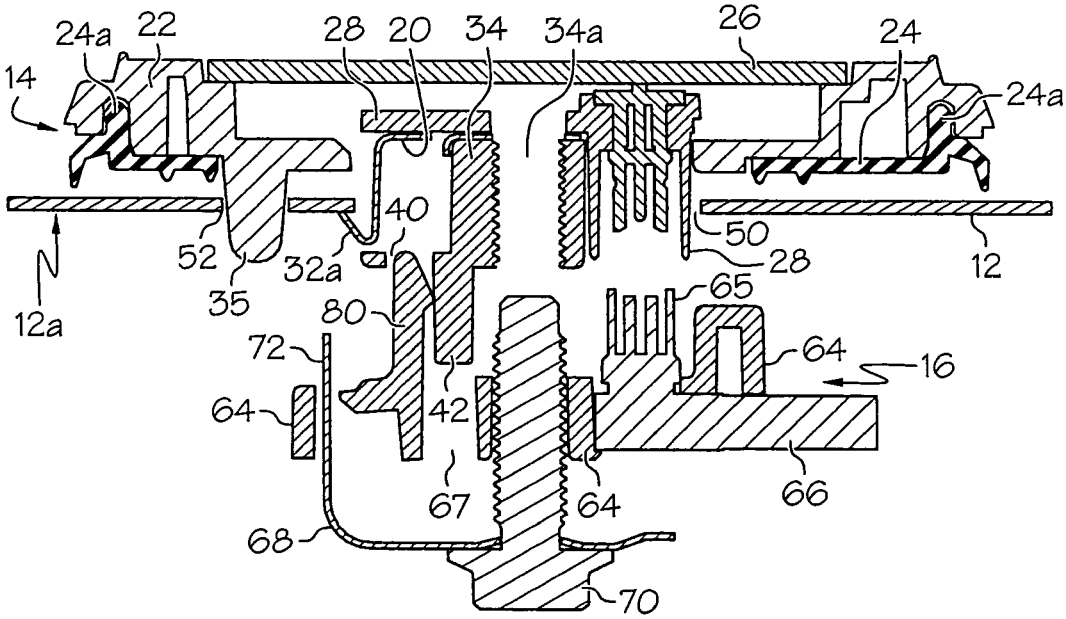
FIGS. 2A-2D are cross-sectional views of interior and exterior components of the antenna module of FIG. 1 during its installation on a vehicle panel.

In the view of FIG. 2A, the exterior component 14 is placed in position on the exterior surface of panel 12, with the boss 34, connector terminals 28 and retainer tangs 32*a* passing through the major opening 50 of panel 12, and the alignment post 35 passing through the minor opening 52. Significantly, the tangs 32*a*-32*c* of retainer clip 20 seat against the inside surface 12*a* of panel 12 to temporarily retain the exterior component 14 in place while the interior component 16 is being installed. FIG. 2A also depicts the interior component 16 being positioned from inside the vehicle cabin for attachment to the installed exterior component 14. In the illustrated position of interior component 16, the finger hooks 80 of connector assembly housing 64 have not yet protruded through the openings 40 of boss 34, and the standoff post 42 has not yet entered the opening 74 of housing 64.

Figure 2B:
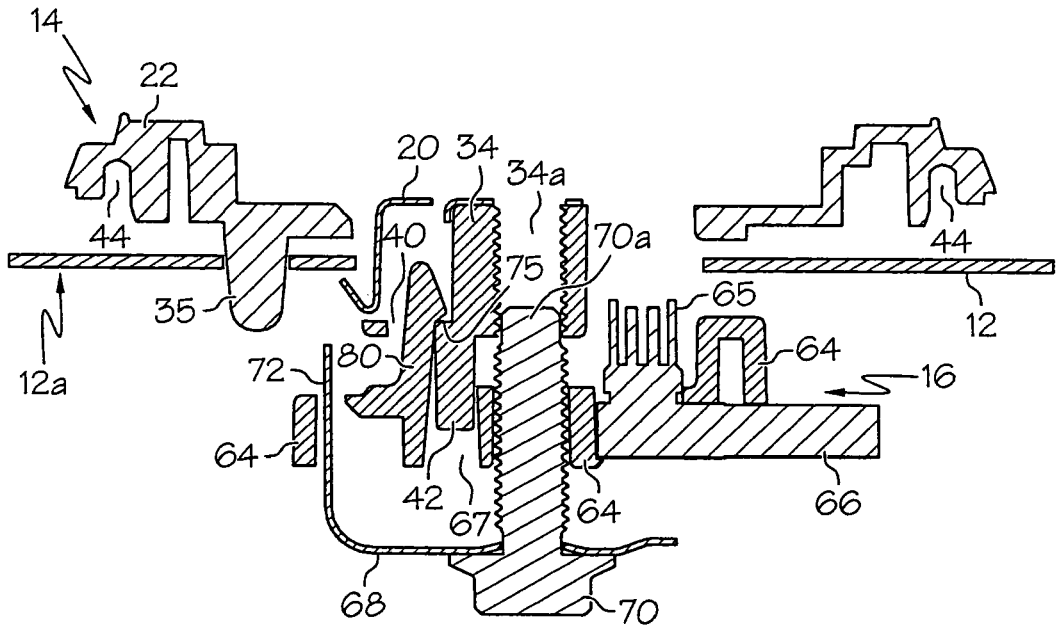

In the view of FIG. 2B, the circuit board 26, connector terminals 28 and gasket 24 have been omitted for convenience, and the interior component 16 is advanced toward the installed exterior component 14 so that the unthreaded stub 70*a* of bolt 70 is piloted into the opening 34*a* of boss 34. Also, the standoff post 42 has entered the opening 74 of connector assembly housing 64. The interface between bolt stub 70*a* and the opening 34*a* of boss 34 centers the interior component 16 with respect to the exterior component 14, while the interface between standoff post 42 and the opening 74 of housing 64 ensures accurate initial alignment of the connector terminals 28 and 65. At the same time, the finger hooks 80 of connector assembly housing 64 protrude through the boss openings 40 and resiliently engage an internal shoulder 75 of boss 34 to temporarily attach the interior component 16 to the installed exterior component 14. At this stage, the finger hooks 80 temporarily attach both the exterior and interior components 14 and 16 to panel 12, and such components do not need to be manually held in place by the installer.

Figure 2C:
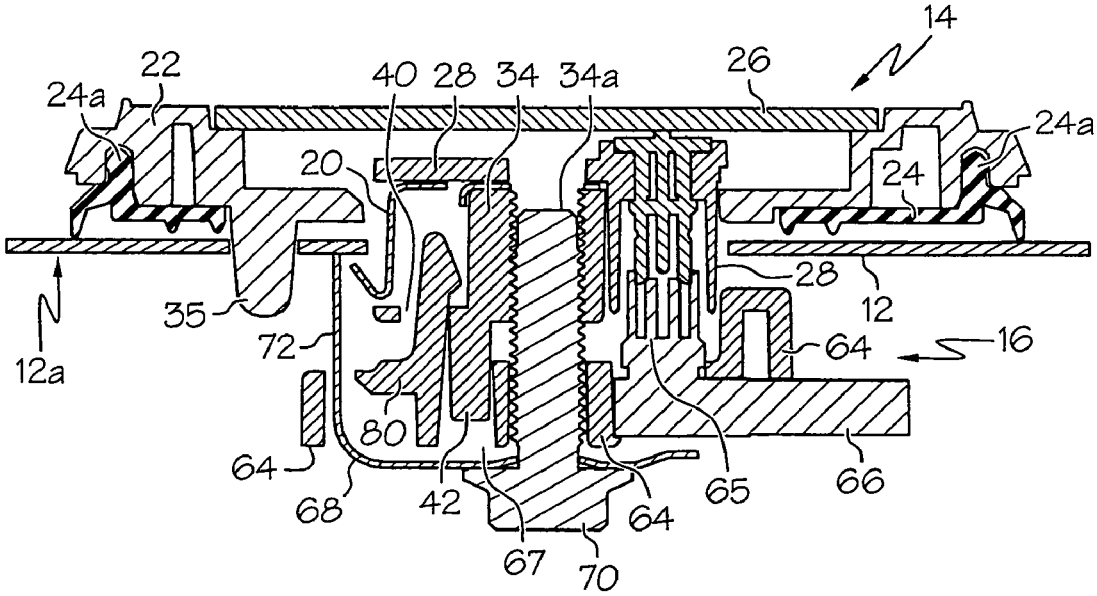
Figure 2D:
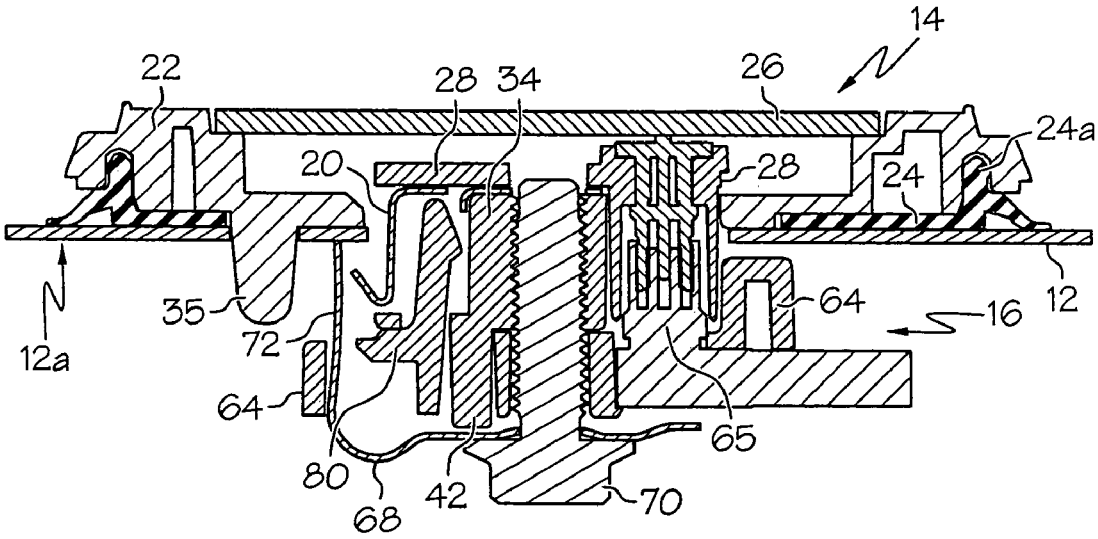

FIGS. 2C and 2D illustrate the process of permanently attaching the exterior and interior components 14 and 16 to panel 12 by driving the bolt 70 into the threaded opening 34*a* of boss 34. In the view of FIG. 2C, the bolt 70 has been advanced to the point where the legs 72 of clip 68 contact the interior surface of panel 12. Also, the electrical terminals 28 and 65 of exterior and interior components 14 and 16 begin to engage, and complementary features on the boss 34 and the connector assembly housing 64 ensure accurate alignment of the connector terminals 28, 65 as they come together. In the view of FIG. 2D, the bolt 70 has been driven to the point where the base of clip 68 adjacent the bolt 70 engages the standoff 42 of boss 34, limiting the travel of bolt 70. At this point, the connector terminals 28, 65 are fully coupled and the gasket 24 is pressed against the exterior surface of the panel 12. The legs 72 of clip 68 are allowed to yield or buckle as shown in this final stage of attachment, which compensates for variations in the thickness of panel 12 and cumulative dimensional variations in the antenna assembly due to individual component tolerances. Once the antenna module 10 has been so installed, the cables 66 are connected to the vehicle wiring harness, completing the installation.

In summary, the present invention provides an antenna module that is easily and quickly installed by one person if desired, while ensuring secure mechanical attachment and reliable electrical connections. While the present invention has been described with respect to the illustrated embodiment, it is recognized that numerous modifications and variations in addition to those mentioned herein will occur to those skilled in the art. For example, the antenna module 10 may be mounted on a panel other than a roof panel, the standoff post 42 could be mounted on the interior component 16 instead of the exterior component 14, and so on. Accordingly, it is intended that the invention not be limited to the disclosed embodiment, but that it have the full scope permitted by the language of the following claims.

The invention claimed is:

1. An antenna module for installation on a vehicle panel, the antenna module comprising:

an exterior component adapted to be placed against an exterior surface of said panel, said exterior component including an antenna circuit and a first set of connector terminals electrically coupled to said antenna circuit;

an interior component adapted to be placed against an interior surface of said panel and joined to said exterior component, said interior component including a second set of connector terminals, wherein said first set of connector terminals is joined with said second set of connector terminals by the joining of said interior component to said exterior component to electrically couple said antenna circuit to said second set of connector terminals;

a bolt that is threaded into said exterior component for joining said interior component to said exterior component; and a clamping element that is driven into contact with the interior surface of said panel as said bolt is threaded into said exterior component, wherein said exterior component includes a standoff post that is contacted by said clamping element to limit a travel of said bolt and wherein a portion of said clamping element that contacts the interior surface of said panel is yieldable and buckles before said clamping element contacts said standoff post to compensate for dimensional variations.

2. The antenna module of claim 1, wherein:

said interior component includes a set of jumper cables coupled to said second set of connector terminals for attachment of said antenna module to a wiring harness of said vehicle.

3. The antenna module of claim 1, wherein:

said exterior component includes a resilient retainer clip having tangs that seat against the interior surface of said panel for temporarily maintaining the placement of said exterior component against said panel.

4. The antenna module of claim 1, wherein:

said interior component includes resilient hooks that seat against said exterior component to retain the placement of said interior component against said panel.

5. The antenna module of claim 4, wherein:

said exterior component includes openings in which the resilient hooks of said interior component are received for aligning said second set of connector terminals with said first set of connector terminals.

6. The antenna module of claim 1, further comprising:

a first retainer mechanism for temporarily maintaining the placement of said exterior component against said panel;

a second retainer mechanism for temporarily maintaining the placement of said interior component against said panel; and a bolt for joining said interior component to said exterior component.

7. The antenna module of claim 6, wherein:

said bolt is captured in said interior component and threaded into said exterior component, said bolt having an unthreaded stub that is initially piloted into said exterior component to center said interior component with respect to said exterior component.

8. The antenna module of claim 1, wherein:

said interior component includes an opening in which the standoff post of said exterior component is received for aligning said second set of connector terminals with said first set of connector terminals.

* * * * *